US006962614B2

(12) United States Patent
Katafuchi

(10) Patent No.: US 6,962,614 B2
(45) Date of Patent: Nov. 8, 2005

(54) ADDITIVE FOR DIESEL PARTICULATE FILTER

(75) Inventor: Tadashi Katafuchi, Chiba (JP)

(73) Assignee: Idemitsu Kosan Co., Ltd., Tokyo (JP)

( * ) Notice: Subject to any disclaimer, the term of this patent is extended or adjusted under 35 U.S.C. 154(b) by 0 days.

(21) Appl. No.: 10/344,696

(22) PCT Filed: Aug. 21, 2001

(86) PCT No.: PCT/JP01/07165

§ 371 (c)(1),
(2), (4) Date: Feb. 24, 2003

(87) PCT Pub. No.: WO02/16532

PCT Pub. Date: Feb. 28, 2002

(65) Prior Publication Data

US 2003/0182847 A1 Oct. 2, 2003

(30) Foreign Application Priority Data

Aug. 22, 2000 (JP) ..... 2000-250545
Aug. 22, 2000 (JP) ..... 2000-250546
Aug. 22, 2000 (JP) ..... 2000-250547

(51) Int. Cl.[7] ..... C10L 5/00

(52) U.S. Cl. ..... 44/629; 502/100; 502/208; 502/211

(58) Field of Search ..... 44/354, 629; 508/161, 508/162, 164; 502/60, 87, 305, 100, 208, 211

(56) References Cited

U.S. PATENT DOCUMENTS 4,203,854 A * 5/1980 Silverstein ..... 508/167
4,356,079 A * 10/1982 Desaau ..... 208/421
4,647,293 A * 3/1987 Cahill et al. ..... 44/362
4,912,077 A * 3/1990 Lachman et al. ..... 502/302
5,292,991 A * 3/1994 Lachman et al. ..... 585/850
5,628,802 A 5/1997 Karol et al. ..... 44/367
5,744,430 A 4/1998 Inoue et al. ..... 508/295
6,010,987 A * 1/2000 Stiefel et al. ..... 508/363
2002/0042348 A1 * 4/2002 McNeil et al. ..... 508/118

FOREIGN PATENT DOCUMENTS

JP 57091726 A * 8/1982
JP 6-2526 1/1994
JP 6-330056 11/1994

* cited by examiner

*Primary Examiner*—Cephia D. Toomer
(74) *Attorney, Agent, or Firm*—Oblon, Spivak, McClelland, Maier & Neustadt, P.C.

(57) ABSTRACT

An additive to a fuel oil for a Diesel engine having a Diesel particulate filter (DPF), which comprises a molybdenum compound and having the function of improving the combustion property of a particulate matter (PM) trapped with DPF; a fuel oil comprising the additive; a lubricating oil composition for a Diesel engine having DPF, which has a sulfated ash content of 1.0% by weight or smaller, a sulfur content of 0.3% by weight or smaller and a molybdenum content of 100 ppm or greater; and DPF for removing PM in combustion gas discharged from a Diesel engine vehicle by trapping and burning PM, DPF comprising a filter supporting a molybdenum compound. The combustion property of PM trapped with the filter of DPF is improved, PM is burned at a low temperature with stability, the efficiency of removal of PM is improved and the life of DPF is increased.

2 Claims, No Drawings

ADDITIVE FOR DIESEL PARTICULATE FILTER

BACKGROUND OF THE INVENTION

1. Field of the Invention

The present invention relates to a Diesel particulate filter (hereinafter, abbreviated as DPF), an additive used for a fuel oil or a lubricating oil composition for a Diesel engine having DPF and a fuel oil comprising the additive. More particularly, the present invention relates to the DPF, the additive, the fuel oil and the lubricating oil composition which improve the combustion property of a particulate matter (hereinafter, abbreviated as PM) trapped with a filter of DPF, enable combustion of PM at a low temperature with stability, improve the efficiency of removal of PM and increase the life of DPF.

2. Description of the Related Arts

Diesel engine vehicles have advantages in that the fuel efficiency is more excellent than that of gasoline engine vehicles, the amount of carbon dioxide is reduced effectively and cost of gas oil used as the fuel oil is lower than that of gasoline. However, PM contained in the combustion gas discharged from Diesel engine vehicles is recently regarded as a great problem on the environmental pollution. PM is minute residues of combustion of fuel oils such as soot and it is known that PM adversely affects the respiratory system when PM is taken into the human body. Therefore, the reduction in the amount of PM in the discharged gas is the greatest problem for Diesel engine vehicles.

In Japan, in accordance with the new regulation which is to be enforced by 2005, every manufacturer of Diesel engine vehicles must reduce the amount of the discharged PM to ⅓ of the amount in accordance with the present regulation. In the municipality of Tokyo, it is under study that installation of DPF should be enforced to all Diesel engine vehicles by 2003. It is highly possible that the same regulation is enforced in other municipalities, also.

Under the above circumstances, the development of efficient and practical DPF has been actively conducted and several types of DPF have been proposed. Specifically, (1) DPF of the alternate regeneration type, (2) DPF of the continuous regeneration type by oxidation with $NO_2$, (3) DPF of the continuous regeneration type by the catalytic oxidation and (4) DPF of the intermittent regeneration type have been proposed.

In DPF (1) of the alternate regeneration type, two filter units each having a metal net heater and a protective metal net disposed on both faces of a non-woven fabric of a carbon silicate fiber are used and the trapping and the regeneration are conducted by switching the operations alternately between the two filter units. This DPF can be used for the currently used gas oil having a great content of sulfur. However, this DPF has drawbacks in that a great electric current is required for combustion of PM and a dynamo having a great capacity must be installed for this purpose alone and, moreover, that the filter may be damaged due to rapid combustion.

In DPF (2) of the continuous regeneration type by oxidation with $NO_2$, a porous ceramic filter of cordierite having the wall-flow honeycomb structure is used as the filter. This is an apparatus of the continuous regeneration type in which $NO_x$ is oxidized into $NO_2$ by an oxidation catalyst placed at the upstream of the filter and PM trapped with the filter is burned at a lower temperature by utilizing the strong oxidizing ability of $NO_2$. However, this DPF has a drawback in that, since the activity of the oxidation catalyst is decreased by sulfur in the exhaust gas and the function of the catalyst is not sufficiently exhibited, the sulfur content in the fuel oil must be decreased and the application of this DPF to the currently used gas oil is difficult.

In DPF (3) of the continuous regeneration type by the catalytic oxidation, a porous ceramic filter of cordierite having the wall-flow honeycomb structure coated with two types of metal catalysts is used. This is an apparatus of the continuous regeneration type in which no heating apparatus such as a heater is necessary and PM trapped by the filter is burned by the working of the metal catalysts alone. This DPF can be applied to the currently used gas oil since the metal catalysts are relatively less susceptible to the effect of sulfur in the exhaust gas. However, this DPF is susceptible to the effect of phosphorus and the smaller the sulfur content, the more excellent the performance. Moreover, the application of this DPF to vehicles and passenger cars driven at a low speed for a long time is difficult since it is necessary that the vehicle be driven under a condition such that the temperature of the exhaust gas is 300° C. or higher for a specific fraction of time in the entire driving time.

In DPF (4) of the intermittent regeneration type, a porous ceramic filter of carbon silicate having the wall-flow honeycomb type is used as the filter for trapping PM. For the regeneration, the temperature of the exhaust gas is elevated by injecting the fuel. The temperature is further elevated by oxidation of hydrocarbons and carbon dioxide by the working of the oxidation catalyst and PM is burned. In this DPF, a cerium compound is added to the fuel oil and the amount of formed PM is decreased. This DPF can be applied to the currently used gas oil. However, this DPF has drawbacks in that an apparatus for the source of electricity for regeneration is necessary and that cerium oxide remains after the combustion of PM and is accumulated in the filter and the life of DPF is decreased.

As described above, DPF currently under development are not always satisfactory.

Industrially, it is important that the function of DPF is effectively exhibited and the life is increased. It is important for this purpose that the amount of the discharged PM is decreased and PM is burned at a temperature as low as possible.

It is also important that clogging of the filter is prevented as much as possible while PM is burned at a temperature as low as possible. When the filter is clogged, the efficiently of the Diesel engine is decreased due to an increase in the backpressure. The clogging of the filter are caused by clogging with residues of the combustion of PM and by clogging with ashes from the lubricating oil.

As the method for decreasing the amount of the discharged PM and for lowering the temperature of combustion of PM, (i) a method comprising lowering the temperature of combustion of PM by adding a cerium compound to the fuel oil as described in DPF (4) of the intermittent regeneration type and (ii) a method comprising decreasing the amount of the discharged PM by adding a salt of an alkaline earth metal or an iron compound to the fuel oil, have been known.

However, method (i) comprising adding a cerium compound has a drawback in that cerium compounds remain after the combustion and is accumulated on the filter and the life of DPF is decreased although the amount of PM can be decreased when the cerium compound is added in a relatively great amount. Method (ii) comprising adding a salt of an alkaline earth metal or an iron compound has a drawback in that residues of the combustion are accumulated on the filer and the life of DPF is decreased in a similar manner to that in method (i) described above.

SUMMARY OF THE INVENTION

Under the above circumstances, the present invention has an object to provide an additive to a fuel oil for a Diesel engine having DPF which improves the combustion property of PM trapped with a filter of DPF, enables combustion of PM at a low temperature with stability, improves the efficiency of removal of PM and increases the life of DPF and a fuel oil comprising the additive.

The present invention has another object of providing a lubricating oil composition for a Diesel engine having DPF which improves the combustion property of PM trapped with a filter of DPF, decreases clogging of a filter in DPF with ashes, enables combustion of PM at a low temperature with stability, improves the efficiency of removal of PM and increases the life of DPF.

The present invention has still another object of providing DPF which traps PM in the combustion gas discharged from a Diesel engine vehicle with a filter, improves the combustion property of PM, enables combustion of PM at a low temperature with stability, improves the efficiency of removal of PM and increases the life of DPF.

As the result of intensive studies by the present inventors to achieve the above objects, it was found that the combustion property of PM was improved by adding a small amount of a molybdenum compound to a fuel oil for a Diesel engine; the objects could be achieved by a lubricating oil composition having a sulfated ash content of a specific value or smaller, a sulfur content of a specific value of smaller and a molybdenum content of a specific value or greater; the combustion property of PM trapped with the filter was improved and the combustion at a low temperature was enabled by supporting the molybdenum compound on the filter; and the above effects were exhibited with stability without being affected by other components in the exhaust gas such as sulfur compounds and phosphorus compounds and the objects were achieved. The present invention has been completed based on the above knowledge.

As the first aspect, the present invention provides an additive to a fuel oil for a Diesel engine having a Diesel particulate filter, the additive comprising a molybdenum compound and having a function of improving a combustion property of PM trapped with the Diesel particulate filter, and a fuel oil comprising the above additive.

As the second aspect, the present invention provides a lubricating oil composition for a Diesel engine having DPF, the composition having a sulfated ash content of 1.0% by weight or smaller, a sulfur content of 0.3% by weight or smaller and a molybdenum content of 100 ppm or greater.

As the third aspect, the present invention provides DPF for removing PM in a combustion gas discharged from a Diesel engine vehicle by trapping and burning PM, DPF comprising a filter supporting a molybdenum compound.

DESCRIPTION OF THE PREFERRED EMBODIMENTS

The present invention will be described in detail in the following.

In the first aspect of the present invention, the additive to a fuel oil for a Diesel engine having DPF of the present invention (occasionally, referred to as the additive to a fuel oil of the present invention) is an additive used for improving the combustion property of PM trapped with the filter of DPF and enabling combustion of PM at a low temperature. In the present invention, a molybdenum compound is used.

The molybdenum compound is not particularly limited as long as the compound can be dispersed or dissolved in the fuel oil for a Diesel engine and can be suitably selected from various molybdenum compounds. It is preferable that the molybdenum compound is soluble in oil.

Examples of the oil-soluble molybdenum compound include molybdenum salts of alkylphosphoric acids, molybdenum salts of organic acids such as molybdenum salts of carboxylic acids, molybdenum thiophosphate and molybdenum thiocarbamate. The molybdenum compound may be added to the fuel oil directly or in the form of a solution after being dissolved into a suitable organic solvent. When molybdenum thiophosphate or molybdenum thiocarbamate is used, the molybdenum compound is added in an amount such that the total sulfur content in the fuel oil is within the range specified by the standard for the fuel oil for a Diesel engine. Among the above molybdenum compounds, molybdenum compounds producing $MoO_3$ or phosphomolybdic acid as the residue of combustion are preferable.

The molybdenum compound may be used singly or in combination of two or more. The amount of the molybdenum compound is selected so that the content in the fuel oil is 100 ppm or smaller as expressed by the amount of molybdenum. When the amount of molybdenum exceeds 100 ppm, corrosion may take place in the smoke channel. Moreover, the accumulation of the residue of PM on the filter increases and there is the possibility that the life of DPF decreases.

The molybdenum compound is converted into molybdenum oxide or complex oxides of molybdenum and other elements and contained in the exhaust gas. These compounds are trapped with the filter, mixed into PM, improve the property for combustion of PM and lowers the temperature of combustion by 40 to 50° C. This effect is exhibited with stability without being affected by other components in the exhaust gas such as sulfur compounds and phosphorus compounds.

The fuel oil for a Diesel engine to which the additive to a fuel oil of the present invention is added is not particularly limited. Examples of the fuel oil for a Diesel engine include fuel oils conventionally used for a Diesel engines such as fuel oils obtained by adding various additives such as agents for improving fluidity at low temperatures, agents for improving the lubricating property, agents for improving the cetane number and detergents, where necessary, to a base oil comprising gas oil as the main component.

As described above, the additive to a fuel oil of the present invention improves the combustion property of PM trapped with the filter of DPF without being affected by other components in the exhaust gas such as sulfur compounds and phosphorus compound when the additive is added in a small amount to the fuel oil for a Diesel engine and enables combustion of PM at a low temperature with stability. Therefore, the efficiency of removal of PM can be increased and the life of DPF can also be increased. The increase in the life is not adversely affected by residues of the combustion since the residues remain on the filter just in very small amounts.

In the second aspect of the present invention, the lubricating oil composition for a Diesel engine having DPF of the present invention (occasionally, referred to as the lubricating oil composition of the present invention) is used as the lubricating oil for a Diesel engine equipped with DPF. As the based oil of the lubricating oil composition, in general, a mineral oil or a synthetic oil is used. The type of the mineral oil or the synthetic oil is not particularly limited. In general, an oil having a kinematic viscosity in the range of 1.5 to 30 $mm^2/s$ at 100° C. is used.

Examples of the mineral oil include paraffinic mineral oils, intermediate mineral oils and naphthenic mineral oils which are obtained in accordance with a conventional process of purification such the purification with a solvent and the purification by hydrogenation.

Examples of the synthetic oil include polybutenes, polyolefins such as (co)polymers of α-olefins, various types of esters such as polyol esters, esters of dibasic acids and esters of phosphoric acid, various types of ethers such as polyphenyl ethers, silicone oils, alkylbenzenes and alkylnaphthalenes.

As the base oil in the present invention, the above mineral oil may be used singly or in combination of two or more, the above synthetic oil may be used singly or in combination of two or more, and a combination of at least one mineral oil and at least one synthetic oil may also be used.

In the lubricating oil composition of the present invention, it is necessary that the sulfated ash content be 1.0% by weight or smaller. The sulfated ash content is a value obtained by burning a sample, followed by adding sulfuric acid to the residue of carbonization obtained by the combustion and by heating and drying the resultant product to the constant weight. In general, this value is used for finding an approximate amount of metallic additives in a lubricating oil composition.

When the sulfated ash content exceeds 1.0% by weight, the amount of ash accumulated on the filter increases. Clogging of the filter with the ash may take place and the life of DPF may be decreased. Moreover, the effect of improving the combustion property of PM exhibited by the molybdenum compound which will be described below is suppressed. From these standpoints, it is preferable that the sulfated ash content is 0.9% by weight or smaller.

It is necessary that the sulfur content be 0.3% by weight or smaller. When the sulfur content exceeds 0.3% by weight, in DPF using a metallic catalyst to which sulfur works as a catalyst poison, the activity of the catalyst is deteriorated and it is difficult that the function of DPF is sufficiently exhibited. From this standpoint, it is preferable that the sulfur content is 0.25% by weight or smaller.

It is necessary that the molybdenum content be 100 ppm or greater. Molybdenum is mixed in PM trapped with the filter of DPF in the form of molybdenum oxide and complex oxides of molybdenum and other elements. As the result, molybdenum exhibits the function of improving the combustion property of PM. The temperature of combustion is lowered by about 40 to 50° C. and the life of DPF is increased. This function is exhibited with stability without being affected by other components in the exhaust gas such as sulfur compounds and phosphorus compounds.

When the molybdenum content is smaller than 100 ppm, the above function is not sufficiently exhibited and the object of the present invention is not achieved. It is preferable that the molybdenum content is 300 ppm or greater. The upper limit of the molybdenum content is decided by the requirement for the sulfated ash content described above.

The molybdenum compound used as the molybdenum source is not particularly limited as long as the compound is dispersed or dissolved in the lubricating oil composition of the present invention and any of inorganic molybdenum compounds and organic molybdenum compounds can be used. Oil-soluble molybdenum compounds which can be dissolved in the lubricating oil composition are preferable. Examples of the oil-soluble molybdenum compound include molybdenum salts of alkylphosphoric acids, molybdenum salts of organic acids such as molybdenum salts of carboxylic acids, alkylamine salts of molybdic acid, phosphomolybdic acid and silicomolybdic acid, molybdenum thiocarbamate (MoDTC) and molybdenum thiophosphate (MoDTP). When MoDTC or MoDTP is used, it is necessary that the requirement for the sulfur content described above be satisfied. Among the above molybdenum compounds, molybdenum compounds producing $MoO_3$ or phosphomolybdic acid as the residue of combustion are preferable.

The lubricating oil composition of the present invention may comprise various types of additives conventionally used for lubricating oil compositions for a Diesel engine. Examples of the additive include metallic detergents, ashless dispersants, antiwear agents, antioxidants, viscosity index improvers, pour point depressants, rust preventives, metal corrosion inhibitors, defoaming agents and surfactants.

Examples of the metallic detergent include calcium sulfonate, calcium salicylate, calcium finate, magnesium sulfonate and magnesium salicylate. The content of the metallic detergent is restricted by the sulfated ash content which is not allowed to exceed 1.0% by weight. When a sulfonate is used, the content of the metallic detergent is also restricted by the sulfur content which is not allowed to exceed 3% by weight.

As the ashless dispersant, in general, boron-based imides and bisimides are used. Examples of the antiwear agent include zinc thiophosphate(ZnDTP)-based antiwear agents and sulfur-based antiwear agents. When an antiwear agent having sulfur is used, it is necessary that the requirement for the sulfur content described above be also satisfied. When a zinc thiophosphate-based antiwear agent is used, it is necessary that the requirement for the sulfated ash content be also satisfied.

The lubricating oil composition for a Diesel engine having DPF can decrease clogging of the filter in DPF with ashes, improve the combustion property of PM trapped with the filter of DPF without being affected by sulfur compounds and phosphorus compounds in the exhaust gas, enables combustion of PM at a low temperature with stability, increases the efficiency of removing PM and also increases the life of DPF.

In the third aspect of the present invention, DPF of the present invention comprises a filter supporting a molybdenum compound on the surface thereof. Examples of the molybdenum compound include molybdenum oxide, molybdic acids such as molybdic acid and polymolybdic acid and heteromolybdic acids such as phosphomolybdic acid and silicomolybdic acid. Sulfates of molybdenum can also be used since these compounds are converted into oxides under the environment of the use. Among the above molybdenum compounds, $MoO_3$ and phosphomolybdic acid are preferable.

The molybdenum compound may be used singly or in combination of two or more.

In the present invention, the above molybdenum compound may be used in combination with other catalysts which are conventionally used such as noble metal catalysts and other metal oxide catalysts.

The material and the shape of the filter supporting the molybdenum compound are not particularly limited and can be suitably selected from the materials and the shapes which are conventionally used for DPF. Examples of the filter include cylindrical filters having pleats made of non-woven fabrics of ceramic fibers of cordierite or silicon carbide or made of non-woven fabrics of metal fibers and porous ceramic filters having the wall-flow honeycomb structure made of cordierite or silicon carbide.

By supporting the molybdenum compound described above on the surface of the filter, PM trapped with the filter can be burned at a low temperature with stability without being affected by other components in the exhaust gas such as sulfur compounds and phosphorus compounds. Therefore, the efficiency of removal of PM can be increased and the life of DPF can be increased. For supporting the molybdenum compound on the filter, for example, a solution or a dispersion of the molybdenum compound is prepared and the filter is dipped into the solution or the dispersion, dried under a stream of the air and then dried in a heated oven.

DPF having the above filter has the filter supporting the molybdenum compound and PM in the combustion gas discharged from a Diesel vehicle is trapped with the filter and burned at a low temperature with stability. The efficiency of removing PM can be increased and the life of DPF can also be increased.

EXAMPLES

The present invention will be described more specifically with reference to examples in the following. However, the present invention is not limited to the examples.

Example 1

Per 100 parts by weight of carbon black [manufactured by MITSUBISHI KAGAKU Co., Ltd.; "MA100"] used as PM, 10 parts by weight of powder of a molybdenum compound shown in Table 1 was mixed as the residue of combustion. The temperature of combustion of the resultant mixture was measured in accordance with DT-TGA (the differential thermal and thermo-gravimetric analysis) in the air while the temperature was elevated at a rate of 10° C./minute. The results are shown in Table 1.

Comparative Example 1

The same procedures as those conducted in Example 1 were conducted except that powder of various metal compounds shown in Table 1 was used as the residue of combustion. The temperature of combustion of carbon black was measured in accordance with the same procedures as those conducted in Example 1. The results are shown in Table 1.

TABLE 1

| Residue of combustion | Temperature of combustion (° C.) |
|---|---|
| Example 1 | |
| $MoO_3$ | 587 |
| phosphomolybdic acid | 587 |
| Comparative Example 1 | |
| no residue | 640 |
| CaO | 653 |
| MgO | 638 |
| $CeO_2$ | 660 |
| $Fe_2O_3$ | 617 |
| $WO_3$ | 642 |
| $SiO_2$ | 647 |
| $SnO_4$ | 632 |
| $TiO_2$ | 638 |

As clearly shown in Table 1, the temperature of combustion of PM was decreased remarkably when the molybdenum compound was present.

Examples 2 to 5 and Comparative Example 2 to 8

Lubricating oil compositions having the compositions shown in Table 2 were prepared. Ash prepared in accordance with the following method was mixed with the compositions and the temperature of combustion was measured in accordance with the same method as that used in Example 1. The results are shown in Table 2.

<Preparation of Ash>

A lubricating oil placed in a crucible was heated at a temperature exceeding the flash point and ignited. When the ignited inflammable materials were entirely consumed, the crucible containing the residual materials was treated by heating in an oven at 500° C. for 3 hours and cooled by being left standing and ash was prepared.

TABLE 2

| | Example | | | | Comparative Example | | | | | | |
|---|---|---|---|---|---|---|---|---|---|---|---|
| | 2 | 3 | 4 | 5 | 2 | 3 | 4 | 5 | 6 | 7 | 8 |
| | Composition (part by weight) | | | | | | | | | | |
| mineral oil | 85 | 85.4 | 85.5 | 85.2 | 86 | 83 | 84.9 | 87.2 | 87 | 85 | 84 |
| metallic detergent | | | | | | | | | | | |
| 300TBN, Ca sulfonate | — | 1.6 | — | — | — | 0.8 | 2.1 | 0.8 | — | — | — |
| 30TBN, Ca sulfonate | — | — | — | — | — | 5.2 | — | — | — | — | — |
| 300TBN, Ca finate | — | | — | 0.3 | — | — | — | 1 | — | — | 2 |
| 170TBN, Ca salicylate | 3 | — | — | 2.5 | 3 | — | — | — | — | 4 | 3 |

TABLE 2-continued

| | Example | | | | Comparative Example | | | | | | |
|---|---|---|---|---|---|---|---|---|---|---|---|
| | 2 | 3 | 4 | 5 | 2 | 3 | 4 | 5 | 6 | 7 | 8 |
| 400TBN, Mg sulfonate ashless dispersant | — | — | 1.5 | — | — | — | — | — | 2 | — | — |
| bisimide | 3 | 4 | 4 | 3 | 3 | 3 | 4 | 3 | 3 | 3 | 3 |
| boron-based imide | 1 | 1 | 1 | 1 | 1 | 1 | 1 | 1 | 1 | 1 | 1 |
| ZnDTP | 1 | 1 | 1 | 1 | 1 | 1 | 1 | 1 | 1 | 1 | 1 |
| MoDTC | 1 | 1 | 1 | 1 | — | — | 1 | — | — | — | — |
| viscosity index improver, OCP | 6 | 6 | 6 | 6 | 6 | 6 | 6 | 6 | 6 | 6 | 6 |
| Properties | | | | | | | | | | | |
| sulfated ash content (% by weight) | 0.92 | 0.91 | 0.90 | 0.89 | 0.91 | 0.9 | 1.12 | 0.91 | 1.11 | 1.12 | 1.13 |
| sulfur content (% by weight) | 0.21 | 0.23 | 0.25 | 0.25 | 0.17 | 0.45 | 0.23 | 0.28 | 0.26 | 0.22 | 0.26 |
| Mo content (ppm) | 400 | 400 | 400 | 400 | — | — | 400 | — | — | — | — |
| Temperature of combustion of PM (° C.) | 605 | 610 | 610 | 595 | 640 | 645 | 640 | 650 | 635 | 640 | 640 |

Notes
TBN: Total base number
Viscosity index improver: OCP (an olefin copolymer)

As shown in Table 2, the temperature of combustion of PM was lower in Examples 2 to 5 than in Comparative Examples 2 to 8 by about 40 to 50° C.

What is claimed is:

1. A Diesel particulate filter for removing a particulate matter in a combustion gas discharged from a Diesel engine vehicle by trapping and burning the particulate matter, the Diesel particulate filter comprising a filter supporting a molybdenum compound, wherein the molybdenum compound is at least a heteropolymolybdic acid.

2. A filter according to claim 1, wherein the molybdenum compound is a heteropolymolybdic acid, which is phosphomolybdic acid.

* * * * *